United States Patent [19]

Kulesza et al.

[11] 4,274,630

[45] Jun. 23, 1981

[54] GAME APPARATUS USING VISUAL/MOTOR SKILLS

[75] Inventors: Ralph J. Kulesza, Chicago; Jeffrey D. Breslow, Highland Park, both of Ill.

[73] Assignee: Marvin Glass & Associates, Chicago, Ill.

[21] Appl. No.: 142,343

[22] Filed: Apr. 21, 1980

[51] Int. Cl.[3] ..... A63F 7/02

[52] U.S. Cl. ..... 273/1 R; 273/120 R

[58] Field of Search ..... 273/1 R, 1 G, 318, 120 R, 273/127 D

[56] References Cited

U.S. PATENT DOCUMENTS

| | | | |
|---|---|---|---|
| 3,387,846 | 6/1968 | Glass et al. | 27/1 R X |
| 3,649,019 | 3/1972 | Barlow | 273/1 R X |
| 3,663,017 | 5/1972 | Lopez | 273/1 R |

*Primary Examiner*—George J. Marlo

*Attorney, Agent, or Firm*—Mason, Kolehmainen, Rathburn & Wyss

[57] ABSTRACT

A novel game apparatus requiring hand/eye coordination includes a plurality of playing pieces such as marbles having different indicia thereon such as color and a hopper for containing a supply of said marbles having an outlet. A dispenser receiving marbles in succession from said outlet is adapted to dispense marbles alternately from spaced apart dispensing positions. A receiver is provided at each dispensing position including a plurality of separate compartments of different colors and manually movable to align selected compartments into position for receiving a marble of the same color. It is an object of the game apparatus to capture all of the marbles of each color in a compartment of similar color in one or both of the manually controlled receivers as the marbles are dispensed in rapid succession from the hopper with marbles of different colors appearing in random order.

14 Claims, 7 Drawing Figures

Fig 2
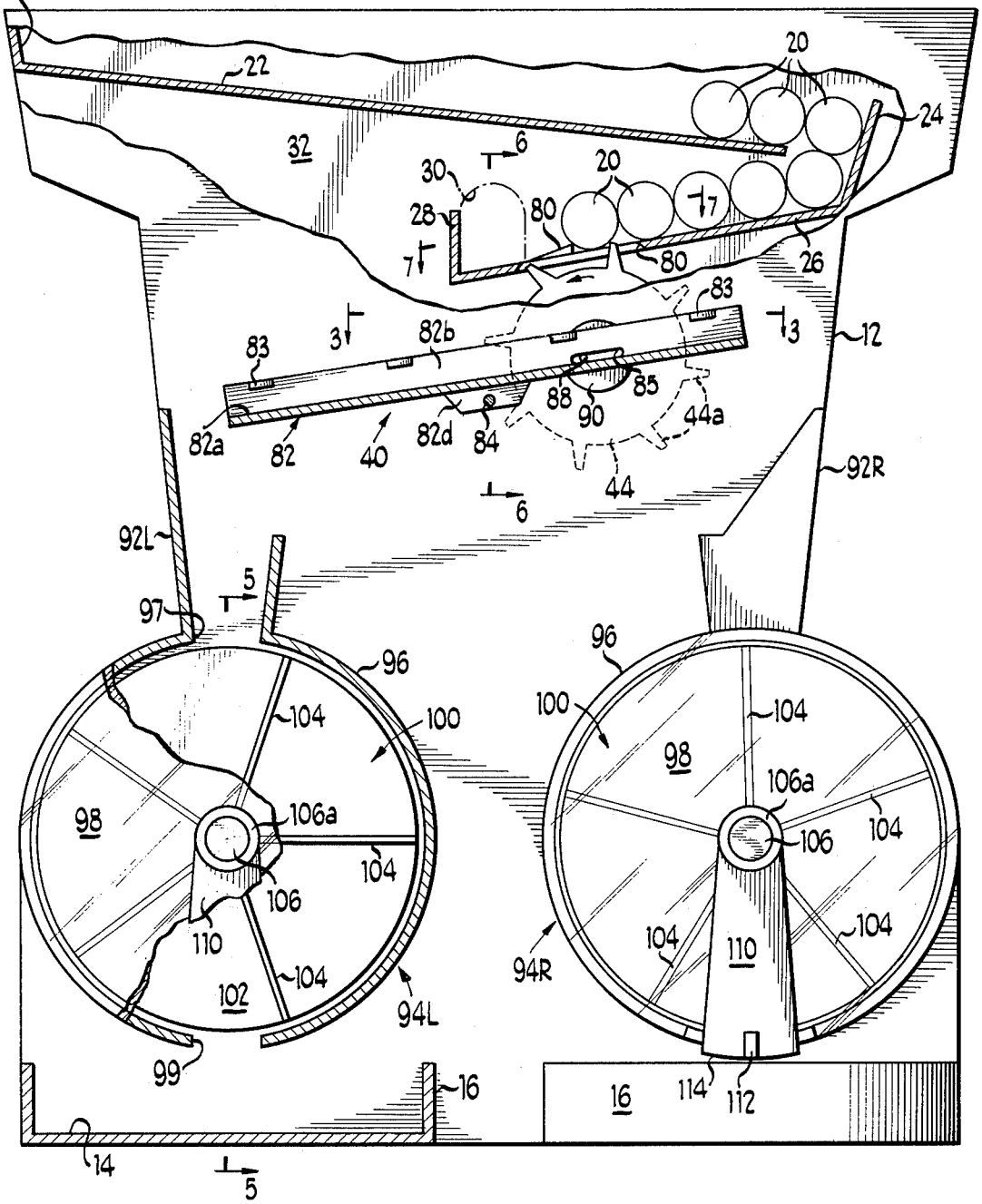
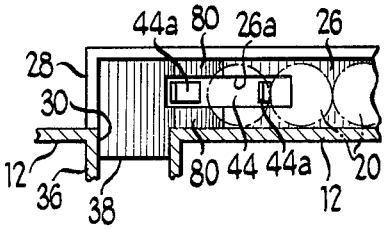
Fig 7

GAME APPARATUS USING VISUAL/MOTOR SKILLS

BACKGROUND OF THE INVENTION

1. Field of the Invention

The present invention relates to game apparatus generally, and more particularly to game apparatus of the type adapted to utilize and/or improve a player's visual/motor skills or hand/eye coordination.

2. Description of the Prior Art

A wide variety of game apparatus have been developed wherein visual/motor skills or hand/eye coordination are tested and/or improved by operation of the game apparatus.

OBJECTS OF THE PRESENT INVENTION

It is an object of the present invention to provide a new and improved game apparatus designed to test and/or improve motor skills and/or hand/eye coordination of a player.

Another object of the present invention is to provide a new and improved game apparatus of the character described especially designed to improve both visual sensory preception and manual dexterity.

Another object of the present invention is to provide a new and improved game apparatus of the character described which is useful for young children or adults and which is adapted for use as a competitive game between players.

Yet another object of the present invention is to provide a new and improved game apparatus of the character described which is neat and pleasing in appearance, easy and fun to play with and which may be manufactured economically on a mass production basis.

SUMMARY OF THE INVENTION

The foregoing and other objects and advantages of the present invention are accomplished in a new and improved game apparatus comprising a plurality of playing pieces having different identifying indicia thereon such as colored marbles or the like. A hopper structure is provided for holding the marbles in suitable quantity and includes a discharge outlet adjacent a dispenser for directing the marbles alternately between a plurality of spaced apart dispensing positions. At each dispensing position there is provided a receiver having a plurality of separate compartments of different colors and manually movable to align a selected compartment into a position ready to receive a marble of the same color from the dispenser. The marbles are dispensed rapidly with colors in random order and the player attempts, with both hands, to manually align the respective compartments of each receiver into a proper position for receiving a marble of the same color. The game apparatus is useful for improving visual/motor skills or hand/eye coordination and serves as a competitive game for young children and adults who are interest in improving their manual dexterity and visual acumen.

BRIEF DESCRIPTION OF THE DRAWINGS

For a better understanding of the invention, reference should be had to the following detailed description taken in conjunction with the drawings in which:

FIG. 2 is an enlarged front elevational view of the apparatus with portions broken away and in section for purposes of clarity;

FIG. 7 is a fragmentary, cross-sectional view taken substantially along lines 7—7 of FIG. 2.

DESCRIPTION OF THE PREFERRED EMBODIMENT

Figure 1:
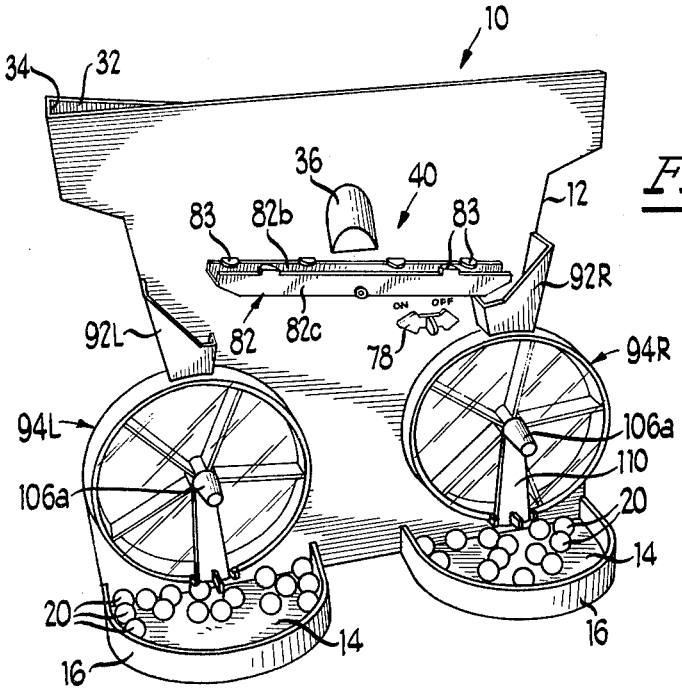
FIG. 1 is a front perspective view of a new and improved game apparatus constructed in accordance with the features of the present invention and shown in a position ready for play.

Referring now more particularly to the drawings, therein is illustrated a new and improved game apparatus constructed in accordance with the features of the present invention and referred to generally by the reference numeral 10. In playing with the apparatus 10, a player's hand/eye coordination or visual/manual dexterity and skill may be improved and the apparatus is useful as a competitive game between different players.

In accordance with the present invention, the apparatus includes an upstanding wall or body structure 12 outlined in the shape of a covered wagon and supported in the upright position as shown, ready for play by a pair of base elements 14 provided with an integral peripheral side wall around the edges resembling the fences of a corral as designated by the reference numerals 16. The bases or corrals 14 are adapted to hold a number of playing pieces in the form of colored marbles 20 which have passed through the game apparatus during play and which are ultimately collected in the corral-like bases.

In the embodiment as illustrated, the marbles are provided with distinct coloring or other indicia thereon for visual identification during play and as illustrated, five different colors or indicias may be provided. At the upper end portion of the wall or body 12, there is provided a hopper-like structure including an upper bottom wall 22 sloped from left to right as shown in FIG. 2, and providing a trough or hopper for containing a supply of the marbles 20 ready for use. At the right hand end, the bottom wall 22 terminates short of an upsloping end wall 24 which guides the marbles downwardly into a sloping lower bottom wall 26 extending downwardly from right to left and terminating in an upstanding end wall 28 adjacent an outlet opening or passage 30 formed in the upstanding wall 12.

Preferably, the sloping bottom walls 22 and 26 and the upstanding end walls 24 and 28 are integrally joined to the backside of the upstanding wall 12 to form the hopper-like structure for containing a relatively large number of colored marbles 20 and an integral back wall 32 and left hand end wall 34 are also provided to complete the hopper-like structure for holding a supply of marbles adjacent an upper level of the wall 12.

Figure 6:
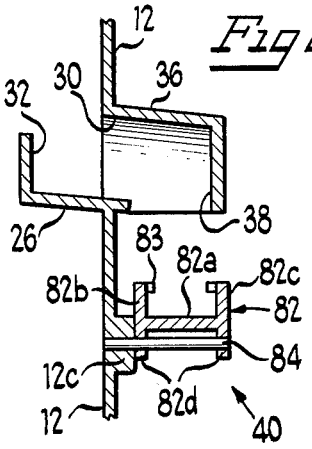
FIG. 6 is a fragmentary, vertical, cross-sectional view taken substantially along lines 6—6 of FIG. 2.

An outwardly protruding discharge chute 36 outlined over the hopper outlet opening 30 is provided on the front wall face of the wall 12 so that the marbles passing through the outlet opening 30 will then drop downwardly through an outlet opening 38 of the chute (FIG. 6) onto a rockable dispensing mechanism or dispenser 40 constructed in accordance with the features of the present invention.

Figure 3:
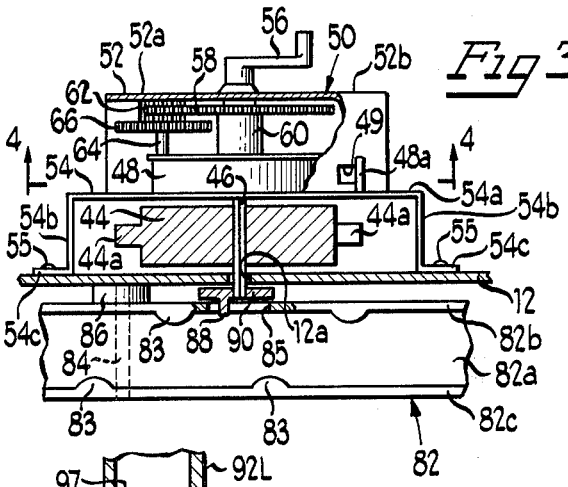
FIG. 3 is a fragmentary horizontal cross-sectional view taken substantially along lines 3—3 of FIG. 2.

The marbles 20 on the lower bottom wall 26 of the hopper structure are discharged through the outlet opening 30, one at a time, in relatively rapid sequence by means of a rotating feeder wheel 44 having radial paddle elements 44*a* spaced circumferentially apart to form spaces large enough for only one of the marbles 20 and small enough to prevent two of the marbles from occupying the same space between adjacent paddle elements. The feeder wheel is mounted for rotation with the drive shaft 46 which projects transversely of the body structure 12 outwardly through a centrally disposed opening 12*a* therein as best shown in FIG. 3.

The rearward end portion of the shaft 46 is secured to a coiled, flat sectioned, spring element 48 providing a spring motor drive assembly generally indicated as 50 mounted on the backside of the covered wagon shaped body structure 12. The inner end of the coiled spring 48 is secured to rotate the shaft 46 and an outer end or tang 48*a* extends upwardly into a slotted opening 49 formed in a top wall section or flange 52*b* of a supporting bracket or base for the spring motor assembly indicated by the reference numeral 52. A back wall or bight portion 52*a* of the base provides a protective wall for the wound up spring element and its associated drive components and a pair of upper and lower flanges 52*b* and 52*c* are secured to a similar U-shaped bracket or housing 54 which substantially encloses or covers the feeder wheel 44 as illustrated in FIG. 3.

The bracket 54 includes a back wall or bight portion 54*a* which serves as a supporting base for the housing 52 and also includes a pair of vertical side flanges 54*b* having lugs 54*c* along the forwardly facing edges, which lugs are secured to the back wall of the body structure 12 by appropriate fasteners 55.

Figure 4:
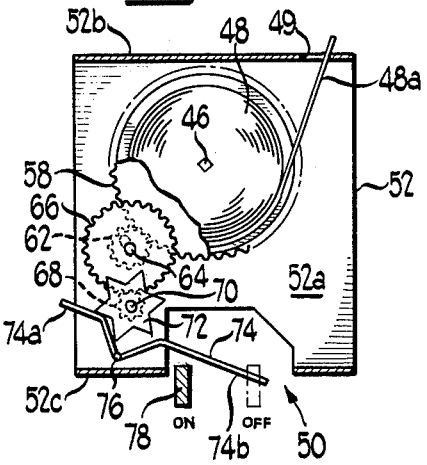
FIG. 4 is a fragmentary, vertical, cross-sectional view taken substantially along lines 4—4 of FIG. 3.

On the rearward end portion of the spring motor shaft 46 there is provided a crank handle 56 used for rewinding the spring motor when the spring tension is run down. A large gear wheel 58 secured to a boss 60 and carried on the spring motor shaft 46 is adapted to intermesh with a smaller pinion 62 mounted on a first jack shaft 64 supported at opposite ends between the walls 52*a* and 54*a* as illustrated in FIG. 3. The pinion 62 is integrally joined with a larger diameter gear 66 which in turn is in meshing engagement with a smaller pinion gear 68 carried on a second jack shaft 70 (as shown in FIG. 4).

The second jack shaft 70 supports a star wheel 72 which is engaged by a V-shaped end portion 74*a* of a pivotal control lever 74 mounted on a pivot axle 76 extending between the back walls 52*a* and 54*a*. An opposite, longer end portion 74*b* of the control lever is adapted to be engageable with an on-off switch actuator 78 which is mounted for horizontal sliding movemment in a slot (not shown) formed in the body or wall structure 12. When the switch 78 is moved to the "off" position as shown in dashed lines in FIG. 4, the end portion 74*a* of the control lever 74 is pivoted upwardly so that the control end portion 74*a* engages an outer portion of a tooth on the star wheel 72 and this engagement restrains the shafts 70, 64 and the spring motor shaft 46 from rotating. With the switch in the "off" position, the crank handle is effective to wind-up and increasae the tension of the coil spring 48. When the control switch 78 is moved to the "on" position and there is remaining tension on the spring, the switch actuator moves out of engagement with the end portion 74*b* of the control lever 74 on the star wheel and interconnecting shafts and spring motor shaft are then free to rotate to drive the feeder wheel 44 in a counterclockwise direction as indicated by the arrow in FIG. 2, and feed the marbles, one at a time, from the lower, hopper trough bottom wall 26 to pass out through the discharge outlet opening 30.

It should be noted that a wall portion of the hopper trough bottom 26 is formed with an elongated slot 26*a* in order to accommodate an upper portion of the feeder wheel and paddles 44*a* which are adapted to engage and lift a marble resting in a lead position in the trough. The lead marble in the trough rests against the edge of a pair of wedge-shaped stop elements 80 on opposite sides of the slot 26*a* and these stops normally prevent the lowermost or lead marble on the bottom wall 26 from freely rolling down toward the end wall 28. As each feeder wheel paddle 44*a* engages a marble, it is lifted over the edge of the stops and rolls down the inclined slope formed of the top surface of the stops. This accelerates the marbles to roll more rapidly downwardly and pass outwardly through the opening 30 and lower outlet 38 in the bottom of the discharge chute 36. The marbles 20 are thus fed, one by one, in rapid succession out through the discharge chute 36 and the feeding action is in random order in respect to the colors of the successive marbles. Accordingly, on the opposite or front side of the wall structure 12, it cannot be readily ascertained which color of marble will be the next one to be fed from the discharge slot onto the dispensing apparatus 40.

The marbles 20 are fed from the discharge chute 36 onto the dispenser assembly 40 in random order of color whenever there are marbles present in the hopper structure and the spring motor 48 is wound and is rotating the motor shaft 46. The motor shaft 46 also provides a source of motive power for rockably driving the dispenser assembly 40 which includes an elongated discharge chute or trough 82 having a bottom wall 82*a* and a pair of inner and outer sidewalls 82*b* and 82*c*. Along the inside upper edges of the sidewalls there is formed a plurality of spaced apart inwardly extending arcuate shaped, tab elements 83 which momentarily retard the rolling movement of the marbles that are dropped onto the central portion of the rockable chute 82 and start to roll towards one or the other of the opposite ends of the chute. The trough or chute 82 is supported for rockable movement about a transverse pivot axle 84 located adjacent the center portion thereof and the axle projects through a pair of integrally formed, downwardly extending brackets 82*d* on the underside of the chute 82 as illustrated. The axle in turn is supported in a relatively thick, cylindrically shaped, boss segment 12*c* which is formed on the front side of the body structure 12.

In order to rock the discharge chute 82 through a limited angle, back and forth, to cause the marbles to roll towards opposite ends of the chute in alternating order, the inner sidewall 82*b* is formed with an elongated slot 85 which accommodates an eccentric pin 88 formed on the outer face of a rotating crank wheel 90 secured to the outer end portion of the spring motor shaft 46. When the spring motor shaft 46 is rotating, the crank wheel 90 and eccentric pin 88 is rotated and engages the upper and lower surfaces of the slot 85 in the sidewall 82*b* to rock the discharge chute 82 about the supporting central axle 84. The tabs 83 prevent the marbles in an upwardly tilted end portion from rolling back towards the center and as opposite end portions of the discharge chute are raised and lowered, the flow of marbles is outwardly from the central portion adjacent the pivot axle 84 toward opposite ends of the chute.

The marbles 20 roll towards the left or right hand end of the dispenser chute 82 depending upon the direction of tilt and when the marble reaches either end of the chute, it drops off downwardly and falls into a receiving inlet chute or hopper-like structure 92L or 92R. The chutes have convergent sidewalls for directing the marbles into respectiive receivers 94L or 94R at a pair of left and right dispensing positions below opposite ends of the rockable chute 82. Each receiver includes a generally cylindrical shaped, hollow chamber and is adapted to be manipulated by the left and/or right hand of a player. Each receiver includes a generally cylindrical sidewall 96 integrally joined with the body structure 12 which forms a back wall thereupon. The receiver sidewall is formed with an inlet opening 97 at the upper end for receiving the marbles from the hopper-like inlet troughs. Each receiver includes a circular outer wall or face 98 formed of transparent plastic material so that the interior of the receiver may be viewed. Within the enclosure of each receiver, there is provided a rotary indexing wheel 100 having a circular disk 102 divided into five arcuate segments, each having a different color corresponding to the colors of the marbles 20. The segments are defined by a plurality of radially extending divider blades or walls 104 integral with the disc and the colored segments on the rotary disk are clearly visible from the outside. The index rotor 100 is formed with a supporting central shaft 106 having a knob portion **106*a* at the outer end to permit ready manipulation and rotation of the rotor to index a segment of a desired color into a ready position for receiving a marble of the same color dropping from the end of the discharge chute 82**.

Figure 5:
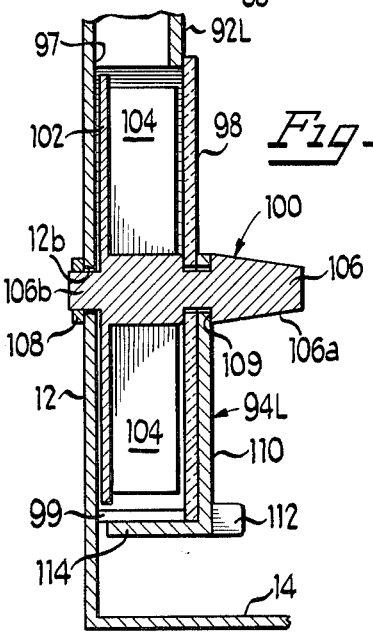
FIG. 5 is a fragmentary, vertical, cross-sectional view taken substantially along lines 5—5 of FIG. 2.

As illustrated in FIG. 5, the rearward end of each shaft 106 is formed with a reduced diameter section **106*b* which extends through and is journaled in a circular aperture 12*b* formed in the upstanding wall structure 12. A lock nut 108 is secured on the outer rearward end portion of the shaft to retain the shaft in position for rotary movement on the structure. An intermediate portion of each shaft 106 is formed with an annular groove 109 for accommodating the transparent front wall of the receiver compartment and the upper end portion of a flexible discharge gate 110 which extends radially downwardly of the shaft as shown. The gate is provided with an integral knob 112 for use in flexing the gate outwardly so that a bottom wall 114 will move out of position below an outlet opening 99 of the cylindrical chamber to discharge collected marbles from the respective chamber compartments into the awaiting corrals 14** after a game is completed. The marbles may then be replaced in the hopper structure ready for the next game.

In using the game, a player turns on the motor with his left and right hands on the respective receiver control knob portions **106*a* and attempts to manipulate the left and right index rotors 100 so that colored sectors of the disks 102 are aligned to receive marbles only of a similar color as they are discharged from an end of the rockable dispenser chute 82**.

A perfect game is achieved when all of the marbles are collected with only marbles of one color collected in colored segments of the receiver of the same color. When marbles of a color different than the collecting compartment color are found, points are subtracted for the error. Score of the game may be kept by competitive players and the game may be scored by indicating the number of mismatches during a complete run of all the marbles in the system. It will thus be seen that the game apparatus 10 provides a useful tool for improving hand/eye coordination and visual acumen. In addition, the game may serve as a competitive game and is extremely useful in developing visual/motor coordination.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Game apparatus comprising:

a plurality of playing pieces having different identifying indicia thereon:

hopper means for holding said pieces having an outlet;

dispensing means for directing said pieces from said hopper outlet alternately between a plurality of spaced apart dispensing positions; and receiving means at each position including a plurality of separate compartments therein and manually movable to align a selected compartment into position for receiving a playing piece from said discharge means having an indicia corresponding to indicia of said selected compartment.

2. The game apparatus of claim 1 wherein said dispensing means comprises a delivery chute having a discharge outlet at opposite ends and rockable in opposite directions to discharge successive playing pieces received from said hopper outlet intermediate said opposite ends to move alternately toward said opposite ends for dispensing to said respective receiving means.

3. The game apparatus of claim 2 wherein said dispensing means includes motor means for rocking said chute back and forth to discharge said successively received playing pieces from one discharge outlet and then the other on a continuing basis.

4. The game apparatus of claim 3 wherein said motor means includes a spring motor and means for rewinding the same.

5. The game apparatus of claim 4 wherein said spring motor is selectively controllable to turn a shaft and including means interconnecting said shaft and said chute to reciprocally rock the chute when said spring motor is released to turn said shaft.

6. The game apparatus of claim 3 including control means for turning said motor means on and off.

7. The game apparatus of claim 6 wherein said motor means includes a rewindable spring motor and said control means includes a shaft driven by said motor having a detent wheel thereon and a control movable into and out of detaining engagement with said shaft to switch said motor on and off.

8. The game apparatus of claim 3 wherein said motor means includes a rotating shaft and a feeder wheel on said shaft for guiding said playing pieces one at a time in succession from said hopper means to said dispensing means.

9. The game apparatus of claim 8 wherein said feeder wheel includes a plurality of separate compartments around the periphery for receiving a playing piece from said hopper means and directing the same to said dispensing means upon rotation of said feeder wheel.

10. The game apparatus of claim 1 wherein at least one of said receiving means includes a generally cylindrical chamber having an inlet and outlet for said playing pieces, a wheel mounted for rotation in said chamber including a plurality of radial dividers extending outwardly of a manually rotatable shaft to form said compartments, and a discharge gate adjacent said outlet manually operable for discharging playing pieces from a selected compartment manually aligned adjacent said outlet by rotation of said shaft.

11. The game apparatus of claim 10 wherein said wheel includes a circular disk having arcuate segments between adjacent pairs of said dividers, said segments having said indicia thereon visible from outside said chamber corresponding to indicia of said playing pieces.

12. The game apparatus of claim 11 wherein said indicia of said playing pieces and said segments comprise different colors.

13. The game apparatus of claim 11 wherein each of said chambers includes at least one side wall opposite said disk formed of light transmitting material to permit viewing the interior of said compartments.

14. The game apparatus of claim 10 wherein each of said receiving means includes a manual control knob on said wheel shaft outside of said chamber.

* * * * *